US007201345B2

(12) United States Patent
Werner et al.

(10) Patent No.: US 7,201,345 B2
(45) Date of Patent: Apr. 10, 2007

(54) REELED MATERIAL SPLICING METHOD AND APPARATUS

(75) Inventors: Peter H. Werner, West Bend, WI (US); James A. Armstrong, Jr., Birmingham, AL (US); Larry L. Hougum, New Berlin, WI (US); Daniel J. Koziczkowski, Grafton, WI (US); Thomas E. Simon, Cedarburg, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 255 days.

(21) Appl. No.: 10/676,168

(22) Filed: Sep. 30, 2003

(65) Prior Publication Data

US 2005/0077418 A1 Apr. 14, 2005

(51) Int. Cl.
*B65H 19/20* (2006.01)

(52) U.S. Cl. ..... 242/554.2; 242/554.4; 242/554.6

(58) Field of Classification Search ..... 242/554.2, 242/554.3, 554.4, 554.5, 554.6
See application file for complete search history.

(56) References Cited

U.S. PATENT DOCUMENTS 3,298,622 A * 1/1967 Raymond et al. ..... 242/554.6
3,323,741 A * 6/1967 Head, Jr. ..... 242/554.3
3,391,877 A * 7/1968 Angell et al. ..... 242/554.1
3,516,617 A * 6/1970 Haner et al. ..... 242/554.2
3,746,272 A * 7/1973 Rotolo ..... 242/554.4
3,813,052 A * 5/1974 Swann et al. ..... 242/554.5
4,337,903 A * 7/1982 Kessler et al. ..... 242/554.2
4,564,150 A * 1/1986 Keene et al. ..... 242/554.6
4,821,973 A * 4/1989 Tafel et al. ..... 242/554.2
4,875,633 A * 10/1989 Mochizuki et al. ..... 242/554.2
5,152,472 A * 10/1992 Spang et al. ..... 242/554.2
5,732,903 A * 3/1998 Madrzak ..... 242/554.5
6,073,876 A * 6/2000 Suzuki et al. ..... 242/554.5
6,096,150 A * 8/2000 Ohno ..... 242/554.6
6,588,696 B1 * 7/2003 Riihela et al. ..... 242/554.5
6,629,664 B2 * 10/2003 Weijenborg ..... 242/554.5
6,764,040 B2 * 7/2004 Kiyota ..... 242/554.2

* cited by examiner

*Primary Examiner*—William A. Rivera
*Assistant Examiner*—Sang Kim
(74) *Attorney, Agent, or Firm*—Patrick S. Yoder; Alexander M. Gerasimow

(57) ABSTRACT

A system and method for splicing reeled media using operational feedback. According to certain embodiments, the method of operating a media production system involves sensing speed parameters of first and second reeled media, tracking an unwinding parameter of the first reeled media, and positionally tracking a leading end position of the second reeled media. The method also involves controlling splicing between the first and second reeled media based at least partially on the speed parameters, the unwinding parameter, and the leading end position.

54 Claims, 6 Drawing Sheets

REELED MATERIAL SPLICING METHOD AND APPARATUS

BACKGROUND OF THE INVENTION

The present technique relates generally to media production systems, such as newspaper systems. More particularly, a unique system and method is provided for splicing a replacement reeled media with an unwinding reeled media based on operational feedback, such as speed feedback, positional feedback, and tension feedback.

In the newspaper industry, reels of media are unwound into a production system, which applies print to the media and organizes the printed media into bundles. As one reel of media unwinds toward its expiration, operators ensure that a replacement reel of media is joined to the expiring reel. Unfortunately, existing techniques result in considerable waste of media and poor joints between the media from the expiring and replacement reels. In some cases, the joints fail or the joints are partially or entirely missed. In addition, existing production systems have poor control of tension in the media. As a result, the media has poor color registration and poor output quality. For example, existing production systems often use pneumatic tension controls, which can have considerable lag time. These lag times are particularly problematic during times of acceleration and deceleration of the production system. Unfortunately, the transition process from the expiring reel to the replacement reel is particularly sensitive to such tension variations. In some cases, poor tension control can result in failed or missed joints.

Accordingly, a technique is needed for controlling the operation of media production systems to improve the transition between unwinding and replacement reeled media.

SUMMARY OF THE INVENTION

The present technique provides a unique system and method for splicing reeled media using operational feedback. According to certain embodiments, the method of operating a media production system involves sensing speed parameters of first and second reeled media, tracking an unwinding parameter of the first reeled media, and positionally tracking a leading end position of the second reeled media. The method also involves controlling splicing between the first and second reeled media based at least partially on the speed parameters, the unwinding parameter, and the leading end position.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
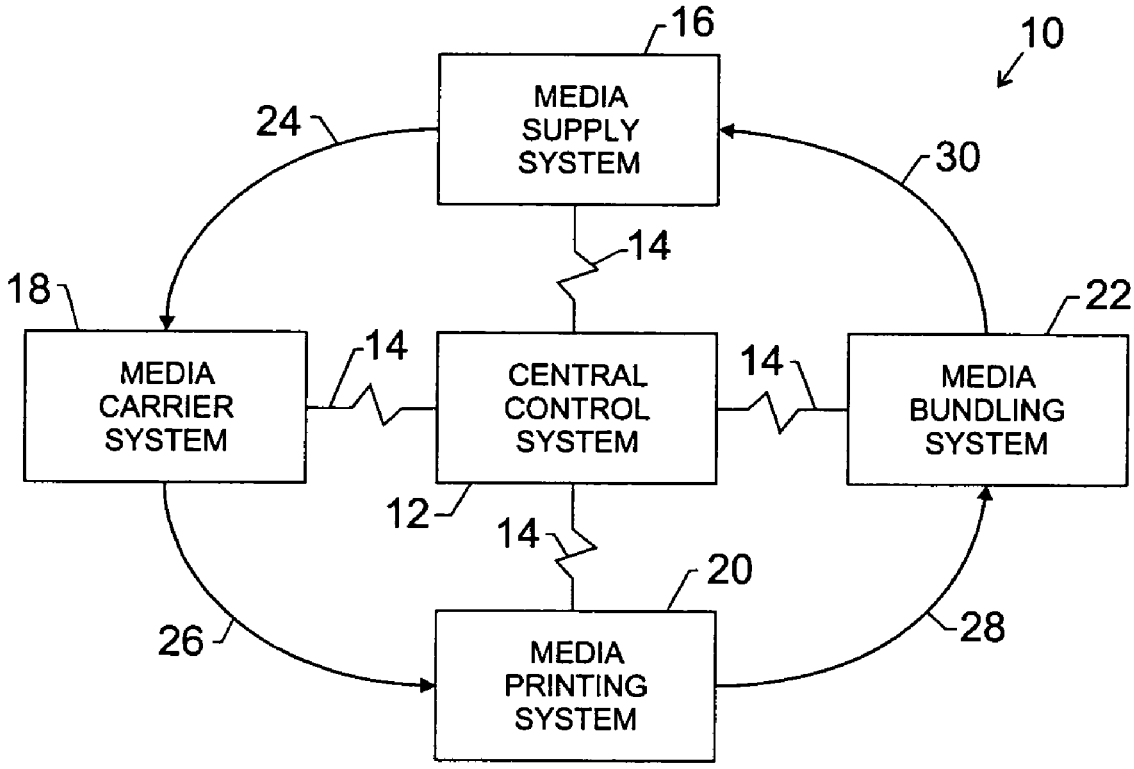
FIG. 1 is a block diagram illustrating an exemplary media production system in accordance with certain embodiments of the present technique.

FIG. 1 is a block diagram illustrating an exemplary media production system 10 in accordance with certain embodiments of the present technique. As illustrated, the media production system 10 comprises a central control system 12 communicatively coupled to various subsystems via a network 14. Although the media production system 10 may comprise a wide variety of different subsystems, the illustrated embodiment comprises a media supply system 16, a media carrier system 18, a media printing system 20, and a media bundling system 22. One exemplary embodiment of the media production system 10 is a newspaper production system. However, any other suitable application is within the scope of the present technique. As indicated by arrow 24, the media supply system 16 is adapted to supply a continuous length of media (e.g., newspaper media) to the media carrier system 18. More specifically, the media supply system 16 unwinds a length of media from a reel. Near the end of the unwinding reeled media, the media supply system 16 splices a replacement reeled media with the unwinding reeled media to ensure a continuous supply of the media to the media carrier system 18. As indicated by arrow 26, the media carrier system 18 transports the unwinding media through the media printing system 20, which operates to print various text and graphics onto the media. In turn, the media bundling system 22 operates to separate, organize, and generally bundle the printed media, as indicated by arrow 28. For example, the media bundling system 22 may organize the printed media into newspaper groups or bundles. Finally, arrow 30 indicates that the media production system 10 may operate continuously to supply, transport, print, and bundle the media.

Figure 2:
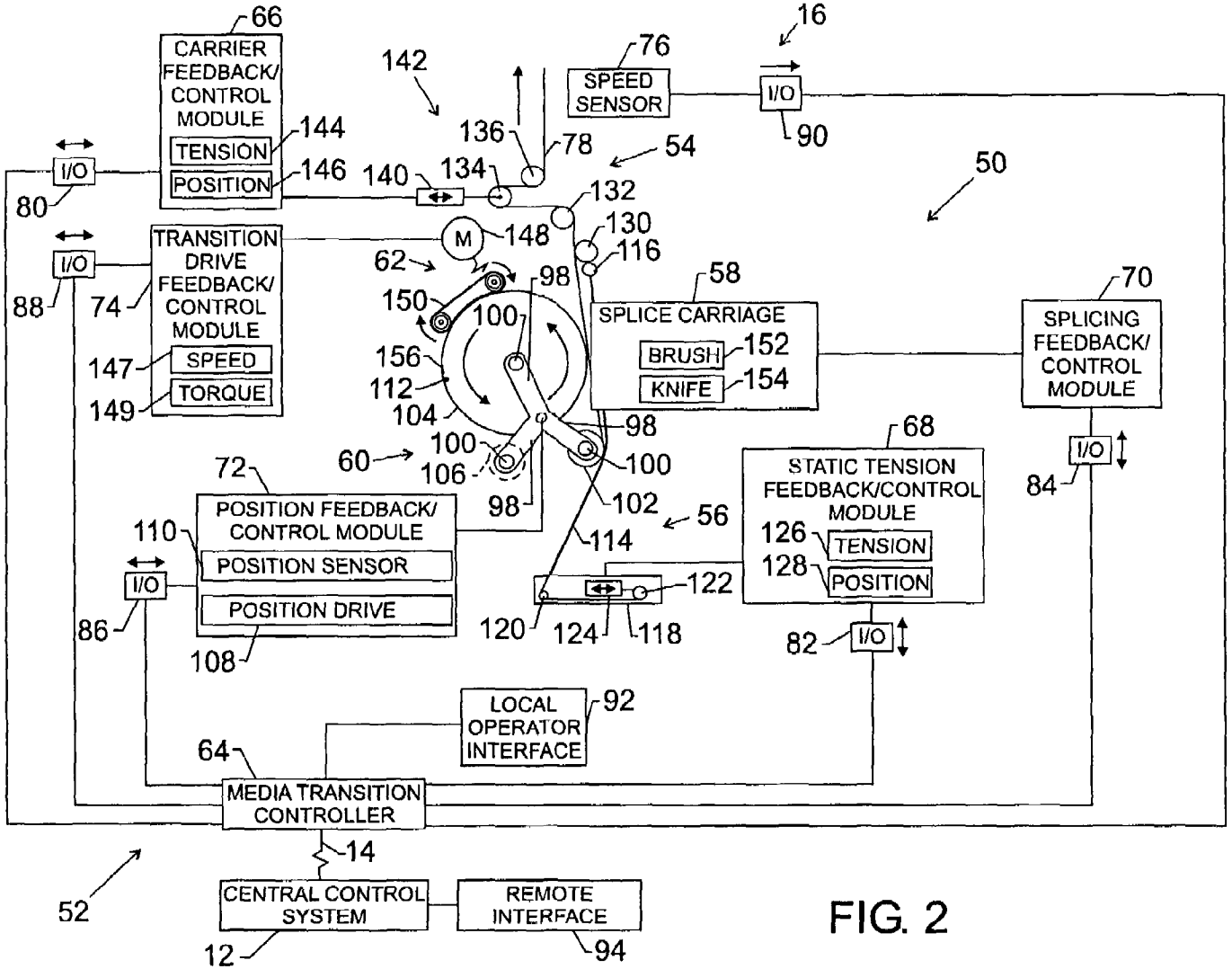
FIG. 2 is a block diagram illustrating an exemplary embodiment of the media supply system having a media transition assembly and a media transition control system in accordance with certain embodiments of the present technique.

FIG. 2 is a block diagram illustrating an exemplary embodiment of the media supply system 16 illustrated in FIG. 1. As illustrated, the media supply system 16 comprises a media transition assembly 50 operatively coupled to a media transition control system 52. The media transition assembly 50 comprises a media carrier assembly 54, a static tensioning mechanism 56, a media splicing carriage 58, a multiple reel support structure 60, and a transition drive 62. The media transition control system 52 comprises a media transition controller 64, which comprises a carrier control/feedback module 66, a static tensioning control/feedback module 68, a splice control/feedback module 70, a reel position control/feedback module 72, and a transition drive control/feedback module 74. In turn, the control/feedback modules 66, 68, 70, 72, and 74 of the media transition control system 52 are communicative with components 54, 56, 58, 60, and 62 of the media transition assembly 50, respectively. Each of these control/feedback modules 66, 68, 70, 72, and 74 may comprise control circuitry, feedback sensors, logical routines, and other mechanisms to interact with the media transition controller 64 and the respective components 54, 56, 58, 60, and 62, respectively. However, in certain embodiments, the media transition controller 64 operates as the central controller for these various control/feedback modules 66, 68, 70, 72, and 74. The media transition control system 52 also comprises a speed sensor 76 to identify the speed of media 78 progressing through the media carrier assembly 54. As indicated by input/output blocks 80, 82, 84, 86, 88, and 90, the media transition controller 64 obtains feedback signals and/or transmits control signals to the control/feedback modules 66, 68, 70, 72, and 74 and speed sensor 76 to provide closed-loop control of the media transition assembly 50. A local operator interface 92 also may be coupled to the media transition controller 64 to facilitate local display, monitoring, user input, and general control of the media supply system 16. In addition, the media supply system 16 may be controlled remotely at an operator interface 94 coupled to the central control system 12.

As illustrated, the multiple reel support structure 60 provides the media 78 to the media carrier assembly 54, which transports the media 78 to the remaining systems 18, 20, and 22 of the media production system 10. The illustrated multiple reel support structure 60 comprises a central rotational drive 96 and a plurality of protruding arms 98. Each of these protruding arms 98 have rotational mounts 100 adapted to support reeled media, such as an unwinding reeled media 102, a replacement reeled media 104, and an expired reeled media 106. In operation, the positioning control/feedback module 72 engages a position drive 108 to move the multiple reel support structure 60 and the mounted reeled media 102, 104, and 106 to a desired position based on positional feedback identified by one or more position sensors 110. The position sensors 110 may comprise unwinding sensors, revolution counters, media end sensors, reeled media diameter sensors, and other suitable feedback mechanisms. For example, position sensors 110 may be provided to track the amount, diameter, revolutions, and/or trailing end position of remaining media on the unwinding reeled media 102. Similarly, position sensors 110 may be provided to track the reel surface position, revolutions, and/or leading end position 112 of media disposed on the replacement reeled media 104. Based on this positional feedback, the position control/feedback module 72 engages the position drive 108 to move the reeled media 102, 104, and 106 in the appropriate position for unwinding the media 78, for tensioning the media 78, and for splicing the unwinding and replacement media 102 and 104, as discussed below.

As the media 78 unwinds, a friction member or static belt 114 of the static tensioning mechanism 56 contacts the outer surface of the unwinding reeled media 102 to provide tension in the media 78. As illustrated, the static belt 114 extends between a pivot joint 116 and a tension adjustment assembly 118, which comprises a pair of roller members 120 and 122 and a linear positioning mechanism 124. The roller members 120 and 122 movably support the static belt 114, such that the linear positioning mechanism 124 can create or release tension in the static belt 114. For example, the linear positioning mechanism 124 may comprise a hydraulic device, a pneumatic device, a motorized device, or other suitable mechanisms. In operation, the static tension control/feedback module 68 senses feedback and/or provides control signals relating to tension 126 and position 128. For example, the static tension control/feedback module 68 may sense tension in the static belt 114 and/or tension in the media 78. Based on this feedback, the static tension control/feedback module 68 can send a positional control signal or command to the linear positioning mechanism 124. In response, the linear positioning mechanism 124 adjusts tension in the static belt 114 to a desired tension based on the feedback. As indicated by input/output block 82, the media transition controller 64 also may interact with the static tension control/feedback module 68 to facilitate the adjustment of the static tensioning mechanism 56. For example, the media transition controller 64 may process various other system parameters (e.g., feedback and controls) and coordinate tensioning control with the carrier control/feedback module 66 and the transition drive control/feedback module 74.

Turning to the other tensioning mechanisms, the media carrier assembly 54 comprises a plurality of rotatable members or rollers, such as rollers 130, 132, 134, and 136. In the illustrated embodiment, the roller 134 is offset from rollers 132 and 136 to extend the media 78 in a U-shaped pattern 138, which facilitates tension control of the media 78. Accordingly, the roller 134 is movably coupled to a positioning mechanism 140, which functions to move the roller 134 as indicated by arrow 142. The positioning mechanism 140 may comprise a hydraulic device, a pneumatic device, a motorized device, or other suitable mechanisms. Together, the positioning mechanism 140 and the roller 134 function as a carrier tensioning mechanism 142. In turn, the positioning mechanism 140 is operatively coupled to the carrier control/feedback module 66 to facilitate feedback and control of the positioning mechanism 140. In operation, the carrier control/feedback module 66 senses feedback and/or provides control signals relating to tension 144 and position 146. For example, the carrier control/feedback module 66 may sense tension in the media 78 based on the U-shaped pattern 138 and the resistance to adjustment by the positioning mechanism 140. Based on this feedback, the carrier control/feedback module 66 can send a positional control signal or command to the positioning mechanism 140. In response, the positioning mechanism 140 adjusts the position of the roller 134, thereby increasing or decreasing the tension in the media 78 passing along the rollers 130, 132, 134, and 136. As indicated by input/output block 80, the media transition controller 64 also may interact with the carrier control/feedback module 66 to facilitate tension adjustment of the carrier tensioning mechanism 142. For example, the media transition controller 64 may process various other system parameters (e.g., feedback and controls) and coordinate tensioning control with the static tensioning mechanism 56 and the transition drive control/feedback module 74.

As mentioned above, the media supply system 16 is adapted to provide continuous runs of media 78 by joining or splicing the replacement reeled media 104 with an unwinding reeled media 102 approaching its expiration. Accordingly, the media transition control system 52 obtains and processes feedback relating to the unwinding condition of the unwinding reeled media 102 and the operational condition of the replacement reeled media 104. For example, the media transition control system 52 may track revolutions, rotational speed, surface speed, reeled media diameter, media tension, trailing end position, leading end position, and/or various other feedback. Based on this feedback, the media transition control system 52 identifies an appropriate time, speed, and position for splicing the unwinding and replacement reeled media 102 and 104. For example, the media transition control system 52 may calculate an approach algorithm or transition pattern, which ensures a smooth transition from the unwinding reeled media 102 to the replacement reeled media 104.

At the appropriate time, the media transition controller 64 engages the transition drive control/feedback module 74 to operate the transition drive 62. As illustrated, the transition drive control/feedback module 74 comprises speed 147 and torque 149 feedback/controls, which facilitate the operation of a motor 148 and belt mechanism 150 of the transition drive 62. In operation, the motor 148 drives the belt mechanism 150 along an outer surface of the replacement reeled media 104. However, other suitable drive mechanisms are within the scope of the present technique. In response to feedback-based control signals, the transition drive 62 accelerates rotation of the replacement reeled media 104 until a surface speed of the replacement reeled media 104 substantially matches a speed of the media 78.

Once speeds are substantially matched, the media transition control system 52 provides a control signal to the position control/feedback module 72, which responds by moving any replacement reeled media 104 into contact with the media 78 being unwound from the unwinding reeled media 102. As discussed in further detail below, the media transition control system 52 generally provides this media-to-media contact at a feedback-controlled time before expiration of the unwinding reeled media 102 and, also, at a feedback-controlled position of the leading end 112 of the replacement reeled media 104. The feedback-controlled position of the leading end 112 is adapted to provide stable media-to-media contact prior to a splicing operation by the media splicing carriage 58, as discussed below. For example, the media transition control system 52 may trigger the media-to-media contact at a desired fraction of one revolution (e.g., approximately 180 degrees) prior to the leading end 112.

Once media-to-media contact is achieved, the media transition control system 52 engages the media splicing carriage 58 to provide a splice between the unwinding and replacement reeled media 102 and 104. As illustrated, the media splicing carriage 58 comprises a contacting member or brush 152 and a cutting member or knife 154. Again, based on various feedback and control signals, the splicing control/feedback module 70 engages the contacting member or brush 152 to facilitate contact and adhesion between the unwinding and replacement reeled media 102 and 104. For example, the replacement reeled media 104 may comprise an adhesive strip 156 adjacent the leading end 112. In operation, the contacting member or brush 152 engages the adhesive strip 156 to facilitate bonding near the leading end 112. In turn, the splicing control/feedback module 70 engages the cutting member or knife 154 to cut the unwinding reeled media 102 at a desired time/distance after bonding at the adhesive strip 156. For example, based on feedback and control signals, the splicing control/feedback module 70 may cut the unwinding reeled media 102 within inches of the adhesive strip 156 and/or leading end 112.

After the splice is complete, the media transition controller 64 also may engage the transition drive control/feedback module 74 to provide a reverse torque or holdback force on the replacement reeled media 104, thereby providing tension control in the media 78. The media transition controller 64 also may coordinate tensioning controls among the transition drive 62, the static tensioning mechanism 56, and the carrier tensioning mechanism 142. After the replacement reeled media 104 is transitioned into position as the unwinding reeled media 102, the transition drive control/feedback module 74 can disengage the transition drive 62 from the reeled media and return tension control to the remaining tension controllers.

As discussed above with reference to FIG. 2, the media supply system 16 operates in a closed-loop with the media transition assembly 50 and the media transition control system 52. In operation, the media transition controller 64 coordinates feedback and controls among the various components of the media transition assembly 50. Using various feedback, the media transition control system 52 substantially improves timing, accuracy, and quality of the transition between unwinding and replacement reeled media 102 and 104. As a result, the media supply system 16 ensures substantially continuous and uniform flow of the media 78, which may be recognized by improved splices, reduced waste, improved color registration, and improved paper output quality.

Figure 3:
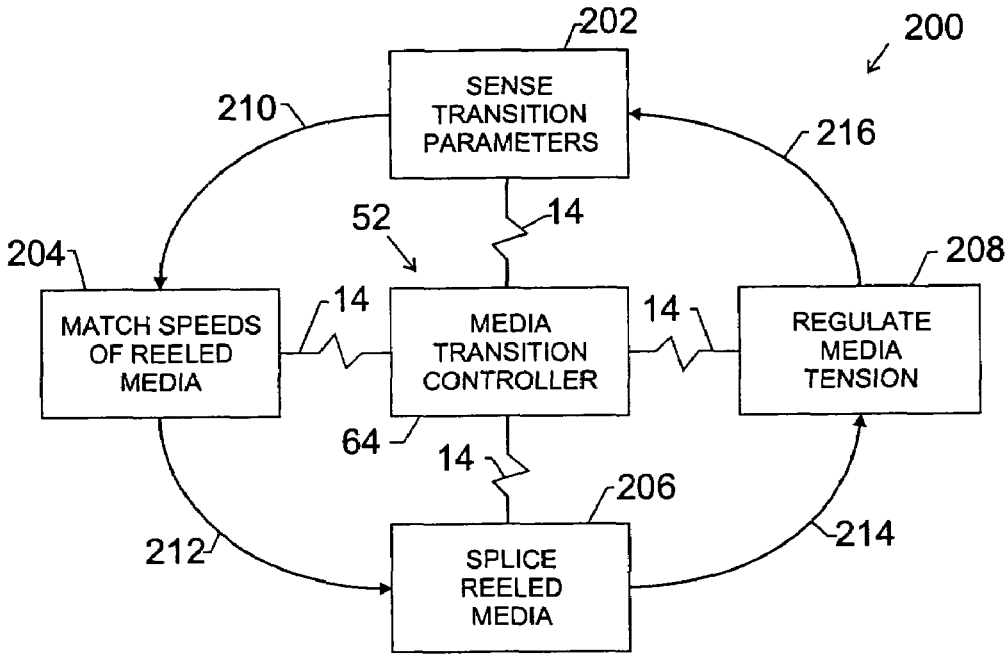
FIG. 3 is a block diagram illustrating an exemplary media transition process in accordance with certain embodiments of the present technique.

FIG. 3 is a block diagram illustrating an exemplary media transition process 200 in accordance with certain embodiments of the present technique. As illustrated, the media transition process 200 is controlled by the media transition control system 52 described in detail above with reference to FIG. 2. At block 202, the media transition process 200 senses a variety of transition parameters, such as unwinding parameters, reel position parameters, media speed parameters, tension parameters, and other desired operational conditions of the media supply system 16. For example, the media transition controller 64 may process a position of the leading end 112 of the replacement reeled media 104, a position of a tailing end or remaining media of the unwinding reeled media 102, a surface speed of the media 78, a surface speed of the replacement reeled media 104, tension of the media 78, and other desired operational parameters.

Based on at least some of these transition parameters, the media transition process 200 of FIG. 3 substantially matches speeds of the unwinding and replacement reeled media 102 and 104 (block 204). For example, the media transition controller 64 may engage the transition drive 62 to accelerate the replacement reeled media 104 toward the surface speed of the unwinding reeled media 102 (e.g., based on speed feedback from speed sensor 76). At block 206, the media transition process 200 splices the unwinding and replacement reeled media 102 and 104. For example, the media transition controller 64 may engage the splice carriage 58 to operate the brush 152 and the knife 154, thereby bonding the reeled media 102 and 104 and subsequently cutting the reeled media 102. Again, the media transition controller 64 provides the appropriate timing and positioning for the foregoing splicing operations based on various transition parameters, such as leading end position 112 of the replacement reeled media 104.

At block 208, the media transition process 200 of FIG. 3 regulates media tension. For example, the media transition controller 64 may engage the static tensioning mechanism 56, the transition drive 62, and/or the carrier position mechanism 140 to provide a smooth transition in the tension before, during, and after the media splicing. As discussed above, the media transition controller 64 can provide a reverse torque or holdback force in the transition drive 62 during the insertion of the replacement reeled media 104 and removal of the unwinding reeled media 102. In this manner, the improved tension control can ensure smooth flow of the media 78, thereby providing better color registration and paper output quality. As indicated by arrows 210, 212, 214, and 216, the media transition process 200 continuously operates to sense transition parameters 202 and to perform speed matching 204, splicing 206, and tensioning 208 based on the sensed transition parameters 202. In this manner, the media transition process 200 comprises a closed-loop control process for transitioning from one reeled media to another.

Figure 4:
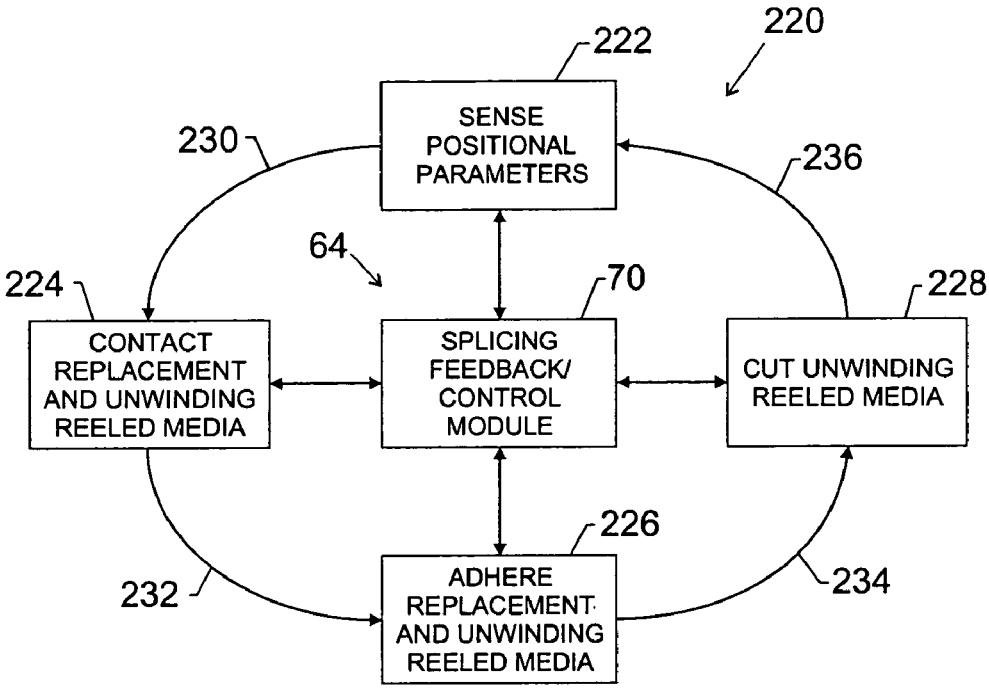
FIG. 4 is a block diagram illustrating an exemplary media splicing process in accordance with certain embodiments of the present technique.

FIG. 4 is a block diagram illustrating an exemplary media splicing process 220 in accordance with certain embodiments of the present technique. As illustrated, the media splicing process 220 is controlled by the media transition controller 64 described in detail above with reference to FIGS. 2 and 3. At block 222, the media splicing process 220 senses a variety of positional parameters, such as remaining media on the unwinding reeled media 102, a position of the leading end 112 of the replacement reeled media 104, a position of the multiple reel support structure 60, and relative positioning between the replacement reeled media 104 and the media 78 being unwound from the unwinding reeled media 102.

Based on at least some of these positional parameters, the media splicing process 220 of FIG. 4 contacts the unwinding and replacement reeled media 102 and 104 (block 224). For example, the media transition controller 64 may engage the position drive 108 to move the surface of the replacement reeled media 104 into contact with the media 78 at a fraction of a revolution before the leading end 112 of the replacement reeled media 104. For example, the precise timing and positioning may be selected to provide adequate time for the media-to-media contact to stabilize before reaching the leading end 112.

At block 226, the media splicing process 220 of FIG. 4 bonds, joins, or generally adheres the unwinding and replacement reeled media 102 and 104. For example, the media transition controller 64 may engage the splice carriage 58 to operate the brush 152, which facilitates adhesion of the bonding material or adhesive strip 156 near the leading end 112. After adhesion, the media splicing process 220 cuts or generally severs the unwinding reeled media 102 (block 228). For example, based on positional feedback tracking the leading end 112, the media transition control 64 may engage the knife 154 to cut the unwinding reeled media 102 within inches of the foregoing bond. As indicated by arrows 230, 232, 234, and 236, the media splicing process 220 continuously operates to sense positional parameters 202 and to perform media contacting 224, media bonding 226, and media cutting 228 based on the sensed positional parameters 222. In this manner, the media splicing process 220 comprises a closed-loop control process for splicing one reeled media to another.

Figure 5:
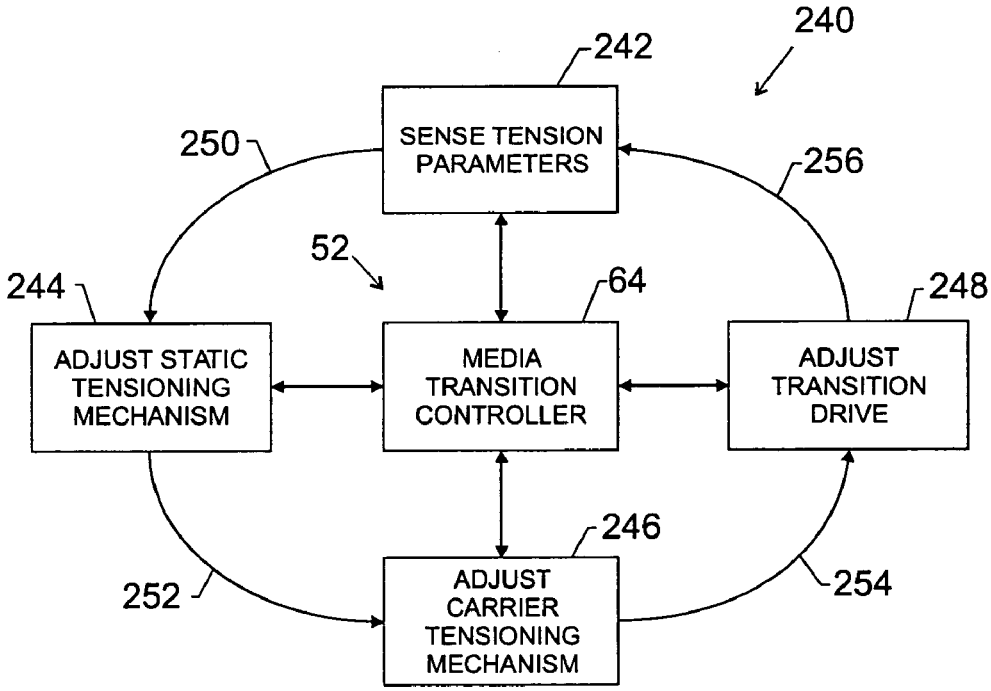
FIG. 5 is a block diagram illustrating an exemplary media tensioning process in accordance with certain embodiments of the present technique.

FIG. 5 is a block diagram illustrating an exemplary media tensioning process 240 in accordance with certain embodiments of the present technique. As illustrated, the media tensioning process 240 is controlled by the media transition controller 64 described in detail above with reference to FIGS. 2 and 3. At block 242, the media tensioning process 240 senses a variety of tension parameters, such as tension 126 sensed by the static tension feedback/control module 68 and tension 144 sensed by the carrier feedback/control module 66. The tension parameters also may comprise positional parameters, such as position 128 sensed by the static tension feedback/control module 68 and position 146 sensed by the carrier feedback/control module 66. Moreover, the tension parameters may comprise positional parameters corresponding to the position of the unwinding and replacement reeled media 102 and 104.

Based on at least some of these parameters, the media tensioning process 240 may adjust the static tensioning mechanism 56 (block 244). Alternatively or cooperatively, the media tensioning process 240 may adjust the carrier tensioning mechanism 142 (block 246). Finally, the media tensioning process 240 may adjust the speed/torque of the transition drive 62 to control tension following a splice of the unwinding and replacement reeled media 102 and 104 (block 248). As a result of these tensioning mechanisms 244, 246, and 248, the tensioning process 240 ensures a substantially uniform tension and smooth flow of the media 78 before, during, and after transition from the unwinding reeled media 102 to the replacement reeled media 104. Again, based on the tension feedback parameters, the media tensioning process 240 comprises a closed-loop control process for tensioning the media 78.

Figure 6:
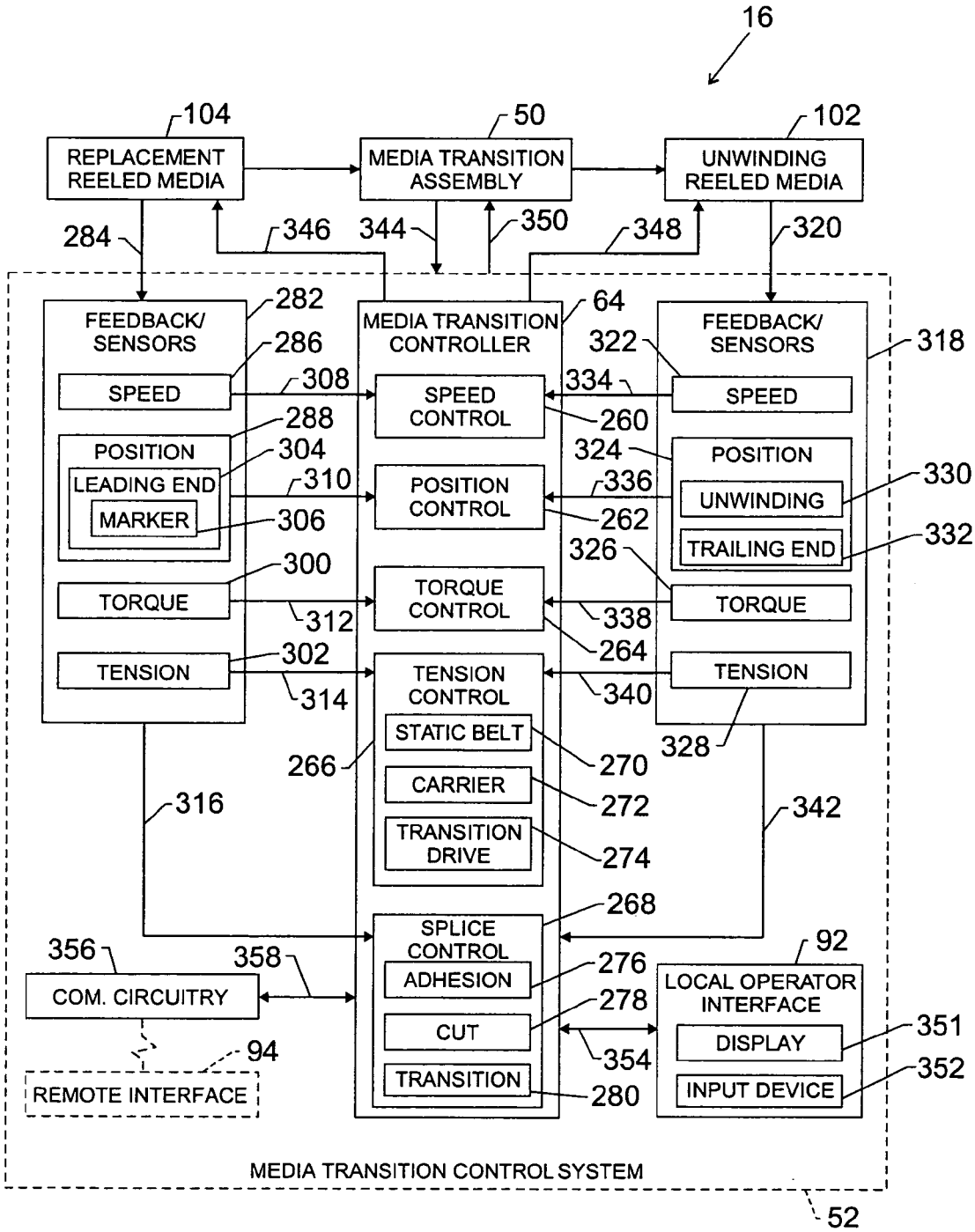
FIG. 6 is a block diagram illustrating an embodiment of the media supply system of FIGS. 1 and 2 in accordance with certain embodiments of the present technique.

FIG. 6 is a block diagram illustrating an embodiment of the media supply system 16 in accordance with certain aspects of the present technique. As illustrated, the media supply system 16 comprises the media transition assembly 50 and the media transition control system 52 for transitioning between the unwinding and replacement reeled media 102 and 104. In this illustrated embodiment, the media transition controller 64 of the media transition control system 52 comprises a plurality of controls, such as a speed control 260, a position control 262, a torque control 264, a tension control 266, and a splice control 268.

For example, the speed control 260 may comprise a reel rotational speed, a drive speed for the transition drive 62, a transition speed for moving the replacement reeled media 104 into contact with the media 78 unwinding from the unwinding reeled media 102, a press speed, a speed of the splice carriage 58, and so forth. Similarly, the position control 262 may comprise a positional path or directional algorithm for moving the multiple reel support structure 60, the transition drive 62, the splice carriage 58, and other movable devices. The torque control 264 may comprise a feedback-based control of torque for the transition drive 62 or other desired devices. As illustrated, the tension control 266 comprises static belt control 270 for the static tensioning mechanism 56, carrier control 272 for the carrier tensioning mechanism 142, and transition drive control 274 for the transition drive 62. Accordingly, the tension controls 270, 272, and 274 may operate cooperatively or separately to provide a desired tension in the media 78 before, during, and/or after the transition process. Finally, the splice control 268 comprises adhesion control 276 for the contacting member or brush 152, cutting control 278 for the cutting member or knife 154, and general transition control 280 for the media transition assembly 50. In operation, the various controls of the media transition controller 64 operate to process feedback and to generate feedback-based controls to ensure a smooth transition from the unwinding reeled media 102 to the replacement reeled media 104.

As illustrated, the media transition control system 52 of FIG. 6 also comprises a variety of feedback/sensors to facilitate the foregoing control of the media transition controller 64. For example, the media transition control system 52 comprises feedback/sensors 282 operable to acquire desired feedback parameters associated with the replacement reeled media 104, as indicated by arrow 284. The feedback/sensors 282 may comprise feedback sensors for speed 286, position 288, torque 300, and tension 302. Other sensors also may be employed within the scope of the present technique. The illustrated speed feedback/sensors 286 may comprise rotational speed, surface speed, drive speed, or other speed data associated with the replacement reeled media 104. The illustrated position feedback/sensors 288 comprise a leading end position sensor 304, such as a transducer or marker 306, which facilitates tracking the circumferential position of the leading end 112 of the replacement reeled media 104. The illustrated torque feedback/sensors 300 comprise a torque sensor for the tension drive 62. However, other torque feedback and sensors are within the scope of the present technique. The tension feedback/sensors 302 may identify or track a holdback force provided by the transition drive 62, tension in the media 78 following a splice between the unwinding and replacement reeled media 102 and 104, or other suitable tension feedback/sensors. Each of these feedback/sensors 286, 288, 300, and 302 are communicative with the media transition controller 64. For example, the speed feedback/sensors 286 are communicative with the speed control 260, as indicated by arrow 308. The position feedback/sensors 288 are communicative with the position control 262, as indicated by arrow 310. The torque feedback/sensors 300 are communicative with the torque control 264, as indicated by arrow 312. The tension feedback/sensors 302 are communicative with the tension control 266, as indicated by arrow 314. Finally, all of the feedback sensors 282 may be communicative with the splice control 268, as indicated by arrow 316. Based on these feedback/sensors 282, the media transition control system 52 controls the media transition assembly 50 with improved timing, improved accuracy, and improved transitional flow.

In addition to feedback/sensors 282, the media transition control system 52 of FIG. 6 comprises feedback/sensors 318 operable to acquire desired feedback parameters associated with the unwinding reeled media 102, as indicated by arrow 320. The feedback/sensors 318 may comprise feedback sensors for speed 322, position 324, torque 326, and tension 328. Other sensors also may be employed within the scope of the present technique. The illustrated speed feedback/sensors 322 may comprise rotational speed, surface speed, press speed, or other speed data associated with the unwinding reeled media 102. The illustrated position feedback/sensors 324 comprise one or more unwinding sensors 330 and a trailing end sensor 332. For example, the unwinding sensors 330 may comprise a revolution counter, a diameter tracker, or other feedback mechanisms to identify the state of unwinding of the unwinding reeled media 102. Similarly, the trailing end position sensor 332 (e.g., a transducer or marker) may be provided to track the radial and/or circumferential position of the trailing end of the unwinding reeled media 102. In this manner, the media transition controller 64 can calculate when the unwinding reeled media 102 will expire. The torque feedback/sensors 326 may comprise any suitable torque feedback and sensors within the scope of the present technique. The tension feedback/sensors 328 may comprise the tension sensor 126 of the static tension feedback/control module 68, the tension sensor 144 of the carrier feedback/control module 66, or other suitable tension feedback/sensors. Each of these feedback/sensors 322, 324, 326, and 328 are communicative with the media transition controller 64. For example, the speed feedback/sensors 322 are communicative with the speed control 260, as indicated by arrow 334. The position feedback/sensors 324 are communicative with the position control 262, as indicated by arrow 336. The torque feedback/sensors 326 are communicative with the torque control 264, as indicated by arrow 338. The tension feedback/sensors 328 are communicative with the tension control 266, as indicated by arrow 340. Finally, all of the feedback/sensors 318 may be communicative with the splice control 268, as indicated by arrow 342. Based on these feedback/sensors 318, the media transition control system 52 controls the media transition assembly 50 with improved timing, improved accuracy, and improved transitional flow.

Altogether, the media transition control system 52 of FIG. 6 utilizes feedback 284 from the feedback/sensors 282, feedback 320 from the feedback/sensors 318, and feedback 344 from the media transition assembly 50 to provide exceptional closed-loop control of the replacement reeled media 104, the unwinding reeled media 102, and the media transition assembly 50, as indicated by control signals or commands 346, 348, and 350. These control signals 346, 348, and 350 may comprise triggering signals, logical commands, routines, and other simple or complex commands depending on the particular application. For example, the control signals or commands may comprise positioning algorithms or coordinated movement commands to facilitate a smooth transition between the unwinding and replacement reeled media 102 and 104.

Operator interaction is also supported by the local operator interface 92 and the remote interface 94, as noted above. In the illustrated embodiment of FIG. 6, the local operator interface 92 comprises a display 351 and one or more input devices 352, such as a keyboard, a mouse, and so forth. Accordingly, the operator can interact with the media transition controller 64 locally, as indicated by communication arrow 354. The media transition control system 52 also may comprise a variety of communication circuitry, such as communication circuitry 356. The illustrated communication circuitry 356 facilitates communication with the remote interface 94, such that an operator can interact with the media transition controller 64 remotely, as indicated by communication arrow 358. Using these interfaces 92, an operator can locally or remotely monitor and interact with the media transition assembly 50 and the media transition control system 52.

Figure 9:
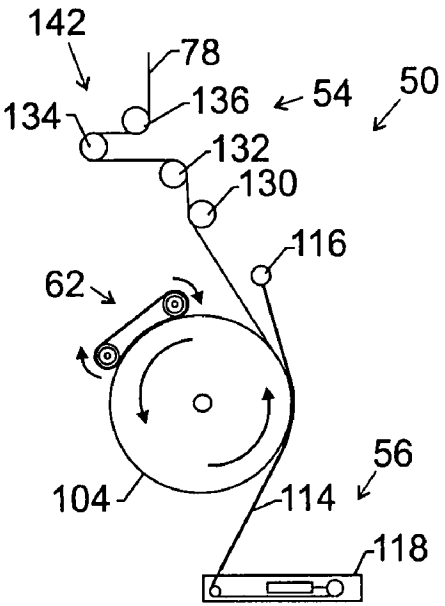
FIGS. 7, 8, and 9 are diagrams of the media transition assembly of FIG. 2 illustrating speed matching, splicing, and tension control in accordance with the media transition process of FIG. 3 in accordance with certain embodiments of the present technique.
Figure 8:
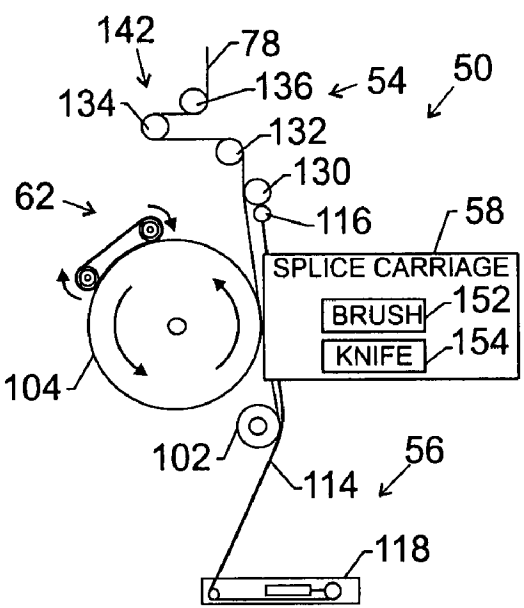
Figure 7:
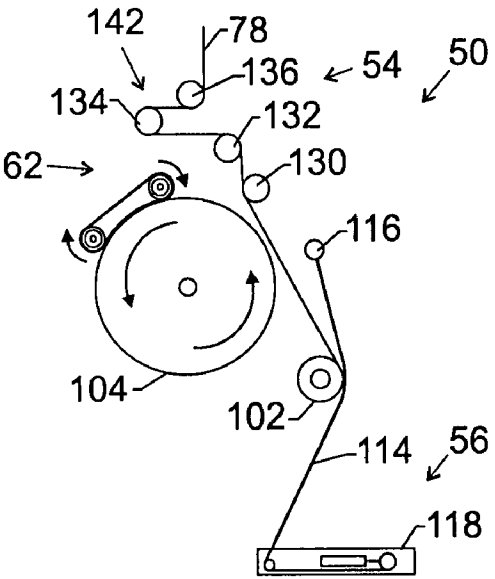

Turning to FIGS. 7, 8, and 9, a more detailed illustration of the media transition process 200 is provided with reference to FIG. 3. As illustrated, FIG. 7 is a diagram illustrating the process of matching speeds of the unwinding and replacement reeled media 102 and 104 within the media transition assembly 50. At this point during the media transition process 200, the transition drive 62 accelerates the surface speed of the replacement reeled media 104 toward that of the unwinding reeled media 102.

Once the speeds are substantially matched, the media transition process 200 proceeds to contact and splice the unwinding and replacement reeled media 102 and 104, as illustrated by FIG. 8. Accordingly, the replacement reeled media 104 is positioned in contact with the media 78 unwinding from the unwinding reeled media 102. The media transition process 200 then engages the splice carriage 58 to contact the brush 152 against the unwinding reeled media 102. In this manner, the brush 152 facilitates adhesion between the unwinding reeled media 102 and the replacement reeled media 104. Once bonded, the media transition process 200 engages the knife 154 to sever the unwinding reeled media 102.

After the splice carriage 58 completes the splice, the media transition process 200 operates to regulate the media tension, as illustrated in FIG. 9. Accordingly, the media transition process 200 may engage the static tensioning mechanism 56, the transition drive 62, and/or the carrier position mechanism 140 to provide a smooth transition in the tension after the media splicing. As discussed above, the transition drive 62 can provide a reverse torque or hold back force to the replacement reeled media 104 after splicing with the unwinding reeled media 102. In this manner, the improved tension control can substantially smoothen the flow of the media 78, thereby providing better color registration and paper output quality.

While the invention may be susceptible to various modifications and alternative forms, specific embodiments have been shown in the drawings and have been described in detail herein by way of example only. However, it should be understood that the invention is not intended to be limited to the particular forms disclosed. Rather, the invention is to cover all modifications, equivalents, and alternatives falling within the spirit and scope of the invention as defined by the following appended claims. For example, the disclosed systems, processes, modules, and devices may comprise software (e.g., routines, programs, or modules), hardware (e.g., circuitry, processors, memory, etc.), static and dynamic electrical/mechanical devices, hydraulic or pneumatic devices, electronic controls, networks, and so forth.

What is claimed is:

1. A method of operating a media production system, comprising:

sensing speed parameters of first and second reeled media;

tracking an unwinding parameter of the first reeled media;

positionally tracking a leading end position of the second reeled media; and controlling splicing between the first and second reeled media based at least partially on the speed parameters, the unwinding parameter, and the leading end position;

controlling a motorized drive to adjust speed of the second reeled media; and controlling the motorized drive to adjust tension of the second reeled media.

2. The method of claim 1, wherein sensing speed parameters comprises identifying surface speeds of the first and second reeled media.

3. The method of claim 1, wherein tracking the unwinding parameter comprises positionally tracking a trailing end position of the first reeled media.

4. The method of claim 1, wherein tracking the unwinding parameter comprises sensing revolutions of unwinding the first reeled media.

5. The method of claim 1, wherein tracking the unwinding further comprises identifying a diameter of the first reeled media.

6. The method of claim 1, wherein positionally tracking the leading end position comprises sensing revolutions of rotating the second reeled media.

7. The method of claim 1, wherein positionally tracking the leading end position comprises sensing a positional marker at the leading end position.

8. The method of claim 1, wherein controlling spicing comprises triggering an adhesion operation prior to a trailing end position of the first reeled media and before the leading end position of the second reeled media.

9. The method of claim 8, wherein triggering the adhesion operation comprises:

contacting the first and second media at a desired fraction of a revolution prior to the leading end position; and bonding the first and second media at a bond region adjacent the leading end position.

10. The method of claim 9, wherein controlling splicing further comprises triggering a cutting operation to cut the first reeled media after the bond region.

11. The method of claim 1, wherein controlling splicing comprises controlling the motorized drive to adjust the speed and controlling the motorized drive to adjust the tension of the second reeled media.

12. The method of claim 1, wherein controlling the motorized drive to adjust speed comprises accelerating a surface speed of the second reeled media toward a surface speed of the first reeled media; and controlling the motorized drive to adjust tension comprises applying a torque opposing a direction of rotation of the second reeled media.

13. The method of claim 12, wherein accelerating is performed prior to a splice of the first and second reeled media and applying the torque opposing the direction of rotation is performed after the splice.

14. The method of claim 1, comprising transitioning from controlling the motorized drive to adjust speed of the second reeled media to controlling the motorized drive to adjust tension of the second reeled media.

15. The method of claim 1, wherein sensing speed, tracking the unwinding parameter, and positionally tracking the leading end position comprise obtaining electronic feedback.

16. The method of claim 1, comprising obtaining electronic feedback for controlling the motorized drive to adjust speed, or tension, or a combination thereof.

17. A system of operating a media production system, comprising:

means for sensing operational parameters of first and second reeled media;

means for controlling splicing of the first and second reeled media based on the operational parameters; and means for transitioning from speed based control to tension based control of the second reeled media to facilitate transitioning and splicing between the first and second reeled media.

18. The system of claim 17, wherein the operational parameters comprise speed feedback of the first and second reeled media.

19. The system of claim 17, wherein the operational parameters comprise media tension feedback.

20. The system of claim 17, wherein the operational parameters comprise media position feedback.

21. The system of claim 20, wherein the media position feedback comprises unwinding condition of the first reeled media and a leading end position of the second reeled media.

22. The system of claim 17, comprising means for independently regulating media tension of the first and second reeled media.

23. The system of claim 17, wherein the operational parameters comprise electronic feedback including tension and speed of the first reeled media, or the second reeled media, or a combination thereof.

24. A system, comprising:

speed sensors adapted to sense speed parameters of first and second reeled media;

an unwinding sensor adapted to track an unwinding parameter of the first reeled media;

a positional sensor adapted to track a leading end position of the second reeled media;

a transition drive controller adapted to transition a motorized media drive from speed control to tension control of the second reeled media; and a media splicing controller adapted to control splicing between the first and second reeled media based at least partially on the speed parameters, the unwinding parameter, and the leading end position.

25. The system of claim 24, comprising a media tension sensor adapted to obtain tension feedback from at least one of the first and second reeled media.

26. The system of claim 25, comprising a tension controller adapted to regulate media tension based on the tension feedback.

27. The system of claim 26, wherein the tension controller is adapted to provide a control signal to a static belt tensioning mechanism.

28. The system of claim 26, wherein the tension controller is adapted to provide a control signal to a media drive belt.

29. The system of claim 25, wherein the adhesion trigger is adapted to provide stable contact between the first and second media leading into a bond region adjacent the leading end position.

30. The system of claim 28, wherein the media splicing controller further comprises a cutting trigger adapted to engage a media cutter to cut the first reeled media after the leading end position.

31. The system of claim 26, wherein the tension controller is adapted to provide a control signal to a tensioning mechanism for a rotatable media carrier.

32. The system of claim 24, wherein the unwinding parameter comprises a trailing end position of the first reeled media.

33. The system of claim 24, wherein the media splicing controller comprises an adhesion trigger adapted to provide contact between the first and second media prior to a trailing end position of the first reeled media and at a desired fraction of a revolution prior to the leading end position of the second reeled media.

34. A program for controlling a media production system, comprising:

a tangible machine readable medium; and machine readable code disposed on machine readable medium and adapted to control splicing between first and second reeled media based at least partially on speed feedback from the first and second reeled media, unwinding feedback from the first reeled media, and positional feedback of a leading end of the second reeled media, wherein the machine readable code is adapted to control speed of a motor driving the second reeled media at least prior to splicing and adapted to control torque of the motor driving the second reeled media at least subsequent to splicing.

35. The program of claim 34, wherein the speed feedback comprises surface speeds of the first and second reeled media.

36. The program of claim 34, wherein the unwinding feedback comprises a trailing end position of the first reeled media.

37. The program of claim 34, wherein the machine readable code is adapted to trigger adhesion between the first and second reeled media adjacent the leading end of the second reeled media and to trigger subsequent cutting of the first reeled media.

38. The program of claim 34, wherein the machine readable code is adapted to regulate tension of at least one of the first and second reeled media based at least partially on tension feedback.

39. A system, comprising:

a first reel structure adapted to support an unwinding media;

a second reel structure adapted to support a replacement media;

a media carrier disposed adjacent the first reel structure and adapted to transport the unwinding media;

a media drive disposed adjacent the second reel structure and adapted to drive the replacement media and to apply a force opposing rotation of the replacement media for a transition from the unwinding media to the replacement media; and a splicing controller adapted to control splicing between the unwinding media and the replacement media based at least partially on speed feedback for the unwinding media and the replacement media, unwinding feedback for the unwinding media, and positional feedback of a leading end of the replacement media.

40. The system of claim 39, comprising a tension controller adapted to regulate media tension based on operational feedback of the unwinding media.

41. The system of claim 40, wherein the media carrier comprises a static belt tensioning mechanism adapted to contact the unwinding media, wherein the tension controller is adapted to provide a control signal for adjusting the static belt tensioning mechanism.

42. The system of claim 40, wherein the media carrier comprises a plurality of rotatable media carriers offset from one another, at least one of the plurality of rotatable media carriers having a positional adjustment for tension in the unwinding media, wherein the tension controller is adapted to provide a control signal for the positional adjustment.

43. The system of claim 40, wherein the tension controller is adapted to provide a control signal to the media drive.

44. The system of claim 43, wherein the tension controller is adapted to engage the media drive to provide a hold back torque alter splicing between the unwinding media and the replacement media.

45. The system of claim 39, wherein the splicing controller comprises an adhesion trigger adapted to provide a control signal to a media contacting device for contacting the unwinding media and the replacement media leading into a bond region adjacent the leading end.

46. The system of claim 39, wherein the splicing controller comprises a cutting trigger adapted to cut the unwinding media after bonding with the replacement media adjacent the leading end.

47. A method for reeled media production, comprising:

providing a splicing controller adapted to control splicing between an unwinding media and a replacement media based at least partially on speed feedback for the unwinding media and the replacement media, unwinding feedback for the unwinding media, and positional feedback of a leading end of the replacement media;

providing a transition drive controller adapted to control a media transition drive to accelerate the replacement media to a surface speed of the unwinding media and to generate a torque that opposes unwinding of the replacement media upon or after being spliced with the unwinding media; and providing a tension controller adapted to regulate media tension based on operational feedback of at least one of the unwinding media and the replacement media.

48. The method of claim 47, comprising providing a speed sensor for at least one of the unwinding media and the replacement media.

49. The method of claim 47, comprising providing a revolutions sensor for at least one of the unwinding media and replacement media.

50. The method of claim 47, comprising providing a positional sensor for a trailing end of the unwinding media.

51. The method of claim 47, comprising providing a positional sensor for the trailing end of the replacement media.

52. The method claim 47, comprising providing a tension sensor for the unwinding media.

53. The method of claim 47, comprising providing the media transition drive adapted to drive the replacement media.

54. The method of claim 53, wherein providing the tension controller comprises providing a drive tension controller adapted to provide a holdback force to the replacement media after splicing between the unwinding media and the replacement media.

* * * * *